United States Patent [19]

Pflieger et al.

[11] 4,142,920

[45] Mar. 6, 1979

[54] PROCESS OF MANUFACTURING A STEEL STRIP BY ROLLING, AND STRIP OBTAINED BY SAID PROCESS

[75] Inventors: Bernard Pflieger, Chamalieres; Andre Reiniche, Beaumont, both of France

[73] Assignee: Compagnie Generale des Etablissements Michelin, Clermont-Ferrand, France

[21] Appl. No.: 803,123

[22] Filed: Jun. 3, 1977

[30] Foreign Application Priority Data

Aug. 6, 1976 [FR] France ..... 76 17479

[51] Int. Cl.[2] ..... C21D 9/52

[52] U.S. Cl. ..... 148/12 B; 148/12.4

[58] Field of Search ..... 148/12 B, 12.4

[56] References Cited

U.S. PATENT DOCUMENTS

| | | | |
|---|---|---|---|
| 3,953,250 | 4/1976 | Golland et al. | 148/36 |
| 4,011,109 | 3/1977 | Golland et al. | 148/12 B |
| 4,017,338 | 4/1977 | Kozak et al. | 148/12 B |

*Primary Examiner*—W. Stallard

*Attorney, Agent, or Firm*—Brumbaugh, Graves, Donohue & Raymond

[57] ABSTRACT

Process for manufacturing a strip with rounded edges, intended for tire reinforcements, by the rolling of a carbon steel wire of circular cross section between rolls of a rolling mill.

In accordance with the invention, the wire is heated as it enters between the rolls of the rolling mill to a temperature above the AC 3 transformation point of the steel used, the heating and the rolling being conducted in a neutral atmosphere.

14 Claims, 3 Drawing Figures

FIG. 1
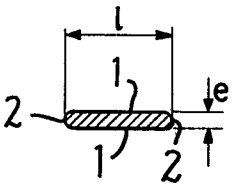
FIG. 1A
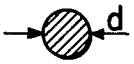
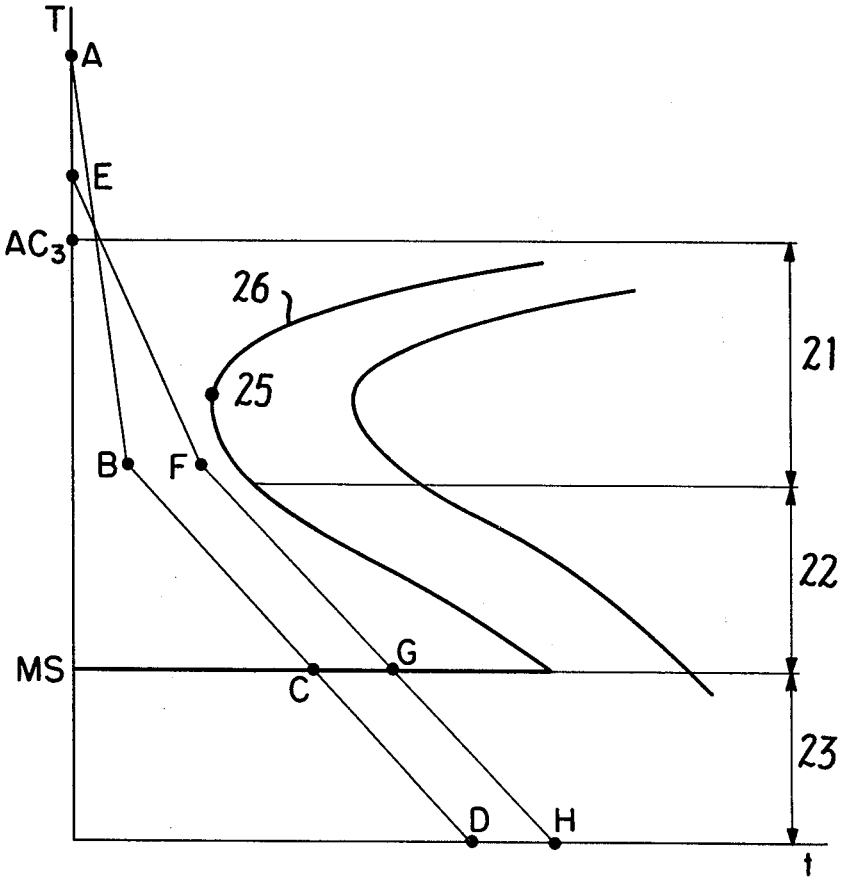
FIG. 2

PROCESS OF MANUFACTURING A STEEL STRIP BY ROLLING, AND STRIP OBTAINED BY SAID PROCESS

The present invention relates to improvements in pneumatic tires and, more particularly, to the metal reinforcement elements used in reinforcement plies for tires.

Tread and/or carcass reinforcement plies formed of metal cables which are parallel to each other and imbedded in a layer of elastomeric mix are successfully employed. In general, these metal cables are produced by the assembling, by stranding, of a plurality of unit wires and/or of strands formed of a plurality of unit wires. The unit wires are customarily of steel. They may be produced by wire-drawing.

It has been attempted to replace the steel cables by strips, since, for the same cross section of metal and length, a strip is less expensive than a cable, due to the simplicity of its manufacture. The manufacture consists of rolling a sheet to thickness and slitting said sheet to the width desired for the strip.

Various metallurgical and/or thermal treatments have been applied during the course of the production of the sheet and/or of the strips. This is the reason why they have a considerable fineness of grain and thus reach ultimate strengths of more than 250 kg/mm$^2$ with relative elongations of more than 5%. Nevertheless, such strips are not entirely satisfactory, due to irregularities of the surface of the edges as well as the sharp edges caused by the slitting of the sheet. The sharp edges, as a matter of fact, constitute loci of concentration of stresses in the strips, the adherence covering thereof, and the elastomer surrounding the strips. This results in fatigue ruptures in the strips and the adjacent elastomer. These drawbacks are combined with poor adherence of the elastomer to the sharp edges of the strip as a result of defects in the adherence coating or in the gluing of the strip caused by the surface irregularities.

Furthermore, it is known (French Pat. No. 1,343,889) to transform a metal wire of circular cross section into a shaped piece by hot rolling. The heating of the wire has the effect of facilitating the flow of the metal between the rolls of the rolling mill which, moreover, snugly follow the contours of the shaped part. Thus, the transformation of the wire into a shaped part is effected in a single pass. However, such shaped parts of steel would be unsuitable for the reinforcing of tires due to their cross section and their irregular surface, which is oxidized and possibly decarburized.

Finally, it is known to transform a wire of circular section into a strip with rounded edges by cold rolling. However, such a strip is just as unsuitable for the reinforcement of tires as the strip obtained by the slitting of a sheet.

The object of the present invention is to overcome the drawbacks which result from the use of the above-mentioned processes.

Thus the process in accordance with the present invention of manufacturing a strip with rounded edges, intended for tire reinforcements, by the rolling of a carbon steel wire of circular cross section between rolls of a rolling mill is characterized by the fact that the wire is heated as it enters between the rolls of the rolling mill to a temperature above the AC 3 transformation point of the steel used, the heating and the rolling being conducted in a neutral atmosphere.

The AC 3 transformation point, which is well-known to metallurgists, is the temperature of the complete transformation of the $\alpha$ phase into the $\gamma$ phase of the steel used.

By the expression "a neutral atmosphere," there is meant an atmosphere which is capable of avoiding at least the oxidation and decarburization of the steel used and therefore of the strip in accordance with the invention.

Preferably, the strip is slowly cooled, after the rolling, in the neutral atmosphere, because the properties of the strip are sensitive as long as the temperature thereof exceeds about 200° C.

The process in accordance with the invention may be used to obtain, in a single pass, strips having preferably a cross section of between about 0.025 and about 1.5 mm$^2$, the ratio between the width and the thickness of this cross section being between about 2 and about 12.

It is advantageous to use carbon steel wire of circular cross section having a carbon content of about 0.7%. This steel is easy to transform by the process of the invention. It is of reasonable cost. The strip obtained is well suited for the reinforcing of tires, particularly when the wire is transformed into a strip having a cross section and a width/thickness ratio within the limits defined above.

These strips are more resistant than the strips obtained by slitting a rolled sheet. The reason for this is that they do not show any internal stresses concentrated at the places where the rounded edges meet the flat faces, nor any cracks or rolling stresses along the said rounded edges.

These strips lend themselves to the depositing of a coating which causes the steel to adhere to the elastomer mix and which is free of defects, whatever the nature of this coating or the process used to deposit this coating on the strip. This results in better adherence of the cured mix to the strips. The cured mix shows no stresses concentrated at the places where the rounded edges adjoin the flat faces of the strips. This results in a better resistance to fatigue on the part of the elastomer mix surrounding the strips in the tires.

The process in accordance with the invention offers the advantage of being less expensive and of avoiding injuring the surface of the strips over other processes which consist of deburring or chamfering the sharp edges of the strips obtained by the slitting of a sheet. Moreover, the cold rolling of a wire leads to a strip which is free of internal stresses and cracks only at the price of numerous rolling passes and intermediate heat treatments.

In the process of the present invention, one can content oneself with subjecting the strip to a slow cooling as it emerges from between the rolls of the rolling mill. However, one can also submit it to additional heat treatments described below, intended to improve the properties and capabilities of the strip.

The slow cooling of the strip effected in a neutral atmosphere imparts to the strip a fine perlite structure which is without fragility. This slow cooling in a neutral atmosphere is preferably applied to a strip obtained from a wire heated to a temperature of from about 750° C. to about 1100° C., the temperature of the strip as it emerges from between the rolls of the rolling mill being a lower temperature of from about 450° C. to about 750° C., preferably from about 450° C. to about 600° C.

As neutral atmosphere one may use cracked ammonia or a gas obtained by combustion of a hydrocarbon (methane, butane, or propane, for instance) or a mixture of hydrocarbons (natural gas, for instance) with a large excess of air, followed by elimination of the water and the carbon dioxide.

Since the process of the invention provides for heating the wire to a temperature above the AC 3 transformation point before it is rolled, it is advisable to use as heating means a means which makes it possible to maintain this temperature up to a very small distance from the rolls of the rolling mill without the rolls, however, being subjected to harmful heating.

With reference to the additional heat treatment to which the strips obtained from the slow cooling, preferably effected under a neutral atmosphere, can be subjected, this additional heat treatment may be of conventional type, for instance, a tempering followed by an annealing or else a bainite tempering. However, this additional heat treatment of the strip is preferably the following three-step treatment.

The first step is a diffusion austenization of sufficient duration to obtain a very homogenous austenite, carried out at an elevated temperature, preferably from about 800° C. to about 1100° C. This diffusion austenization is followed by a two-stage cooling which will be described below.

The second step consists of an austenization intended to refine the grain. This austenization, which is of short duration, is carried out at a temperature very slightly above the temperature of the AC 3 transformation point. This grain-refining austenization is followed by the same two-stage cooling as the diffusion austenization of the first step.

This two-stage cooling comprises a first rapid cooling which terminates close to the temperature separating the perlite zone from the bainite zone, and a second slower cooling from the above temperature to room temperature. The speeds of the two successive coolings are selected in such a manner as to surround the perlite "nose" and the bainite transformation zone in the TTT (temperature, time, texture) diagram corresponding to the composition of the treated strip. The austenizations and at least the first cooling stages are carried out in an oxygen-free medium.

The third step of this additional heat treatment consists in rapidly reheating the strip to a temperature above about 300° C. and then rapidly cooling it.

This third step is followed by finally cooling to room temperature.

When the additional heat treatment consists of a martensite tempering followed by an annealing or a bainite tempering, one can proceed in the following manner.

In the case of a martensite tempering followed by an annealing, the strip is subjected, upon emergence from between the rolls of the rolling mill, to a rapid cooling down to room temperature or even lower, and then to a reheating at a temperature and for a time sufficient to effect an annealing of the martensite.

In the case of a bainite tempering, the strip is subjected, upon emergence from between the rolls of the rolling mill, to a rapid cooling down to a temperature between MS + 20° C. and MS + 200° C. (MS is the temperature at which the austenite starts to be transformed into martensite upon cooling) and then maintained, preferably in a bed of grains of fluidized refractory material, at this temperature for a period of time sufficient to effect the transformation of the austenite into bainite.

In the two additional heat treatments mentioned above, the heating before rolling to a temperature above the AC 3 transformation point takes the place of austenization before tempering.

The slow cooling of the strip upon its emergence from between the rolls of the rolling mill is of course eliminated.

In accordance with another variant, the additional three-step heat treatment described above may also be applied immediately to the strip emerging from between the rolls of the rolling mill. The rolling of the wire is then effected at a speed such that the temperature of the strip, upon emergence from between the rolls of the rolling mill is between the temperature corresponding to the perlite nose and the temperature separating the perlite zone from the bainite zone in the TTT diagram (temperature, time, texture) of the steel used. This three-step heat-treatment is then carried out in the following manner.

The first step consists of a slow cooling which terminates at room temperature.

The second step consists of a grain-refining austenization of the strip. This austenization, which is of short duration, is carried out at a temperature preferably between about 750° C. and about 850° C., which is very slightly above the AC 3 transformation point. This austenization is followed by a two-stage cooling. This cooling starts with a rapid cooling which terminates near the temperature separating the perlite zone from the bainite zone, and then continues with a slow cooling down to room temperature, the rates of slow cooling of the first step and of the two-stage cooling of the second step being so selected as to surround the perlite "nose" and the bainite transformation zone in the TTT (temperature, time, texture) diagram corresponding to the composition of the strip treated. It is recommended that the grain-refining austenization and at least the rapid cooling of said second step be carried out in an oxygen-free medium.

Finally, the third step of this second variant consists of rapid reheating of the strip to a temperature above about 300° C., preferably in an oxygen-free medium, followed by rapid cooling. This rapid annealing is followed by cooling to room temperature.

When the above three-step additional heat treatment is applied, it is advantageous to heat the wire at a sufficient temperature for a sufficient period of time to obtain very homogeneous austenization of the wire. For a steel of about 0.7% carbon, a temperature of from about 800° C. to about 1100° C. is suitable.

The heating of the wire replaces in this variant the diffusion austenization step while the slow cooling which constitutes the first step replaces the second stage of the two-stage cooling of the diffusion austenization step.

In the additional heat treatments described above, nitrogen, argon, or cracked ammonia is advantageously employed as the oxygen-free medium. Furthermore, in the annealing operations, it is advantageous to use beds of alumina or zirconia grains fluidized by means of one of these gases.

Finally, the strip with rounded edges obtained in accordance with the invention is provided with a covering intended to assure satisfactory adherence between the strip and a vulcanizable elastomer mix, after vulcanization of the assembly.

The figures of the accompanying drawing, together with the description thereof and the examples which follow, are intended to illustrate the invention and facilitate an understanding thereof, without however limiting its scope.

In the drawing:

FIG. 1 shows in cross section a strip with rounded edges, in accordance with the invention, obtained from a wire of circular cross section shown in FIG. 1A, and FIG. 2 shows schematically a TTT (temperature, time, texture) diagram corresponding to the additional three-step heat treatments.

In FIG. 1, the cross section of a strip in accordance with the invention is defined, on the one hand, by two faces 1 which are flat, parallel, and opposite. The distance between the two faces 1 is called the thickness (e) of the strip. Moreover, the cross section of the strip is defined by two opposite rounded edges 2 which connect the flat faces 1 to each other. The distance between the two edges 2, measured parallel to the flat faces 1, is the width (l) of the strip.

FIG. 1A shows a wire of circular cross section of diameter (d) obtained, for instance, by the drawing of a wire of a diameter of more than (d).

The TTT diagram of FIG. 2 shows on the temperature (T) axis the points.

AC 3: temperature of the complete transformation of the $\alpha$ phase into the $\gamma$ phase of the steel used, MS: temperature of the start of the transformation of the austenite into martensite (zone 23) during the cooling.

The perlite zone corresponds to the zone 21, the bainite zone to the zone 22, and the perlite nose to the point 25, the point 25 being located on the curve 26 which defines the start of the transformation of the metastable austenite into perlite.

The diagram also shows two cooling curves A B C D and E F G H surrounding the perlite nose 25 and corresponding to two-stage coolings effected during the course of the additional three-step heat treatments described above.

The segment AB of the curve A B C D represents, for instance, a very rapid cooling between the rolls of the rolling mill, and the segment B C D represents the slow cooling which follows it. The segment E F of the curve E F G H represents, for instance, a rapid cooling effected by a jet of neutral gas on the strip, and the segment F G H represents the slow cooling which follows it.

The scale of the temperatures (T) is linear, while the scale of the time (t) is logarithmic.

EXAMPLE 1

There was used a drawn carbon steel wire of 0.565 mm in diameter having the following composition: C = 0.7%, Mn = 0.8%.

In a cracked ammonia atmosphere, the wire was subjected to the following operations in accordance with the invention:

- heating from room temperature to 880° C. in 4 seconds, the temperature at the entrance to the rolls being 850° C.,
- rolling, the speed of the rolls being 848 rpm (diameter of the rolls: 30 mm) and the temperature of the strip being 750° C. at the outlet of the rolls,
- slow cooling from 750° C. to 500° C. in 10 seconds, and
- rapid cooling to room temperature.

The strip had the following properties:

- width: 0.97 mm,
- thickness: 0.25 mm,
- rounded edges free of cracks and surface irregularities of more than 2 $\mu$m,
- surface: free of traces of superficial oxidation and decarburization,
- structure: fine perlite regularly distributed throughout the entire cross section,
- tensile strength: 110 daN/mm$^2$, and
- elongation upon rupture: 7.5%

EXAMPLE 2

The strip of Example 1 was subjected to an additional tempering and annealing treatment in accordance with the following program:

- heating of the strip from room temperature to 900° C. in 5 seconds in an atmosphere of cracked ammonia,
- cooling by means of cracked ammonia from 900° C. to room temperature in 3 seconds, and
- annealing in a bed of alumina grains, fluidized with cracked ammonia, at a temperature of 380° C. from 3.5 seconds.

The strip which had been additionally heat treated in this manner had the following properties:

- structure: annealed martensite (sorbite),
- surface: free of traces of oxidation or decarburization,
- tensile strength: 210 daN/mm$^2$, and
- elongation upon rupture: 2.5%.

EXAMPLE 3

The strip of Example 1 was subjected to an additional heat treatment comprising the following operations:

- heating bringing the strip from room temperature to 900° C. in 5 seconds in a nitrogen atmosphere,
- rapid cooling and maintaining at 320° C. for 10 minutes in a bed of alumina grains fluidized with nitrogen, and
- rapid cooling to room temperature.

The properties of the strip which had been additionally heat treated in this manner were as follows:

- structure: fine bainite,
- surface: free of traces of oxidation or decarburization,
- tensile strength: 215 daN/mm$^2$, and
- elongation upon rupture: 2.6%.

EXAMPLE 4

The strip of Example 1 underwent an additional heat treatment comprising the following operations:

- diffusion austenization bringing the strip from room temperature to 1000° C. in 10 seconds,
- rapid cooling by jets of cracked ammonia from 1000° C. to 500° C. in 0.8 seconds,
- slow cooling in slightly agitated cracked ammonium from 500° C. to 30° C. in 15 seconds,
- refining austenization from 30° C. to 840° C. in 5 seconds,
- rapid cooling by jets of cracked ammonia from 840° C. to 500° C. in 0.8 seconds,
- slow cooling in slightly agitated cracked ammonia from 500° C. to 30° C. in 15 seconds, and
- annealing at a temperature of 370° C. for 3 seconds in a bed of alumina grains fluidized with cracked ammonia.

The properties of the strip which had been additionally heat treated in this manner were as follows:

- tensile strength: 250 daN/mm$^2$,
- elongation upon rupture: 5.5%, and
- fatigue strength very definitely greater than that of the strips of Examples 1 to 3.

EXAMPLE 5

There was used a drawn carbon steel wire of 0.66 mm in diameter having the following composition: C = 0.7%, Mn = 0.3%.

This wire was subjected to the following operations in an atmosphere of cracked ammonia:

heating from room temperature to 800° C. in 4 seconds, rolling between two rolls of a diameter of 60 mm at a speed of 680 rpm, the temperature of the strip upon emergence from the roll being 550° C., cooling of the strip from 550° C. to 30° C. in 3 seconds, and annealing of the strip at 380° C. for 3.5 seconds.

The strip had the following properties:

width: 1.3 mm, thickness: 0.25 mm, rounded edges free of cracks and surface irregularities of more than 2 μm, surface: free of traces of oxidation and decarburization, structure: annealed martensite distributed uniformly throughout the entire cross section, tensile strength: 210 daN/mm$^2$, and elongation upon rupture: 2.5%.

EXAMPLE 6

The cracked ammonia atmosphere of Example 5 was replaced by an atmosphere having the following composition:

$CO_2$ = 0.05%, CO = 0.5%

$H_2$ = 0.5%, $N_2$ = 98.95%

However, the strip emerging from the rolling mill of Example 5 was subjected to a rapid cooling in a bed of alumina grains fluidized by means of the above gas and then maintained at a constant temperature of 325° C. for 10 minutes, and finally to a rapid cooling to room temperature.

The properties of the strip which had been treated in this manner were practically the same as those of the strip of Example 3.

EXAMPLE 7

The strip of Example 5 was subjected at the outlet of the rolls of the rolling mill to the following three-step additional heat treatment:

cooling in slightly agitated cracked ammonia from 550° C. to 30° C. in 15 seconds, refining austenization bringing the temperature of the strip from 30° C. to 840° C. in 5 seconds, rapid cooling by jets of cracked ammonia from 840° C. to 500° C. in 0.8 seconds, cooling in slightly agitated cracked ammonia from 500° C. to 30° C. in 15 seconds, and annealing at a temperature of 375° C. for 3 seconds in a bed of alumina grains fluidized with cracked ammonia.

There was thus obtained a strip having the following properties:

width: 1.3 mm, thickness: 0.25 mm, rounded edges free of cracks and surface irregularities of more than 2 μm, surface: free of traces of superficial oxidation and decarburization, structure: very fine, of annealed martensite distributed throughout the entire cross section, tensile strength: 245 daN/mm$^2$, and elongation upon rupture: 5.6%.

The fatigue strength of the strips in accordance with the invention used in a tire is 30% greater than that of strips which have been treated with equivalent additional heat treatments but have been obtained by slitting from a sheet.

What is claimed is:

1. A process of manufacturing a strip with rounded edges, intended for tire reinforcements by rolling a carbon steel wire of circular cross section in a single pass between rolls of a rolling mill, characterized by the fact that the wire is heated as it enters between the rolls of the rolling mill to a temperature above the AC 3 transformation point of the steel used, the heating and rolling being conducted in a neutral atmosphere.

2. The process according to claim 1, characterized by the fact that the wire is heated to a temperature of from about 750° C. to about 1100° C., the temperature of the strip as it emerges from between the rolls of the rolling mill being a lower temperature of from about 450° C. to about 750° C.

3. The process according to claim 2, characterized by the fact that the strip is subjected, upon emergence from between the rolls of the rolling mill, to a rapid cooling down to a temperature between MS + 20° C. and MS + 200° C., then maintained at this temperature for a period of time sufficient to obtain a bainite structure, and then finally cooled to room temperature.

4. The process according to claim 2, characterized by the fact that the strip is subjected, upon emergence from between the rolls of the rolling mill, to a rapid cooling down to room temperature or lower so as to obtain a martensite structure, then reheated so as to obtain an annealing of the martensite, and then finally cooled to room temperature.

5. The process according to claim 1, characterized by the fact that the wire is rolled at a speed such that the temperature of the strip, upon emergence from between the rolls of the rolling mill, is between the temperature corresponding to the perlite nose and the temperature separating the perlite zone from the bainite zone in the TTT diagram of the steel used, and characterized by the fact that the strip is then subjected to an additional heat treatment in three steps, the first step consisting of a slow cooling to room temperature, the second step consisting of a grain-refining austenization of short duration at a temperature preferably between about 750° C. and about 850° C., which is very slightly above the AC 3 transformation point, this austenization being followed by a rapid cooling terminating near the temperature separating the perlite zone from the bainite zone, then by a slower cooling from the above temperature down to room temperature, the rates of cooling of the first step and of the two coolings of the second step being so selected as to surround the perlite nose and the bainite transformation zone in the TTT diagram corresponding to the composition of the strip treated, the grain-refining austenization and at least the rapid cooling of said second step being carried out in an oxygen-free medium, and the third step consisting of a rapid reheating to a temperature above about 300° C. in an oxygen-free medium, said third step being followed by cooling to room temperature.

6. The process according to claim 1, characterized by the fact that the strip is subjected, upon emergence from between the rolls of the rolling mill, to a slow cooling to room temperature in a neutral atmosphere which is maintained at least to about 200° C.

7. The process according to claim 6, characterized by the fact that the strip is subjected to an additional heat treatment consisting either of a tempering followed by an annealing or of a bainite tempering.

8. The process according to claim 7, characterized by the fact that the additional heat treatment is carried out in a neutral atmosphere.

9. The process according to claim 6, characterized by the fact that the strip is subjected to an additional heat treatment in three steps, the first step consisting of a diffusion austenization at an elevated temperature, preferably between about 800° C. and about 1100° C., for a period of time sufficient to obtain a very homogeneous austenite, this diffusion austenization being followed by a cooling in two stages, the second step consisting of a grain-refining austenization of short duration at a temperature preferably between about 750° C. and about 850° C., very slightly above the temperature of AC 3 transformation point, said grain-refining austenization being followed by a cooling in two stages which is identical to that of the first step, this two-stage cooling comprising a first rapid cooling terminating near the temperature separating the perlite zone from the bainite zone and a second slower cooling from the above temperature to room temperature, the rates of the two successive coolings being so selected as to surround the perlite nose and the bainite transformation zone in the TTT diagram corresponding to the composition of the treated strip, the diffusion and refining austenizations as well as at least the first cooling being carried out in an oxygen-free medium, and the third step consisting of a rapid reheating to a temperature above about 300° C. in an oxygen-free medium, said third step being followed by a cooling to room temperature.

10. The process according to claim 2, characterized by the fact that all of the operations to which the wire or strip is subjected are carried out in a neutral atmosphere.

11. The process according to claim 5, characterized by the fact that the oxygen-free medium is formed of nitrogen, argon, or cracked ammonia, and characterized by the fact that the annealing operations are carried out in beds of alumina or zirconia grains fluidized by means of one of said gases.

12. The process according to claim 1, characterized by the fact that the strip is obtained in a single pass through the rolling mill.

13. The process according to claim 1, characterized by the fact that a carbon steel wire having a carbon content of about 0.7% is used.

14. The process according to claim 1, characterized by the fact that the strip is provided with a coating intended to assure, by vulcanization, satisfactory adherence between the strip and a vulcanizable elastomer.

* * * * *

UNITED STATES PATENT OFFICE

CERTIFICATE OF CORRECTION

Patent No. 4,142,920 Dated March 6, 1979

Inventor(s) Bernard Pflieger and Andre Reiniche

It is certified that error appears in the above-identified patent and that said Letters Patent are hereby corrected as shown below:

ON THE TITLE PAGE,

Item [30], "Aug. 6, 1976" should read -- June 8, 1976 --. Col. 5, line 24, delete the period after "points". Col. 6, line 20, "from" should read -- for --.

Signed and Sealed this

*Twenty-first* Day of *August 1979*

[SEAL]

*Attest:*

*Attesting Officer*

LUTRELLE F. PARKER

*Acting Commissioner of Patents and Trademarks*